US005815586A

United States Patent [19]

Dobbins

[11] Patent Number: 5,815,586

[45] Date of Patent: Sep. 29, 1998

[54] CLOSURE FOR SEALING A MEDICATION CONTAINER

[76] Inventor: John C. Dobbins, 323 Thistle Ln., Southington, Conn. 06489

[21] Appl. No.: 747,616

[22] Filed: Nov. 13, 1996

[51] Int. Cl.[6] ..... B05B 51/00; B05B 7/00; G08B 3/10; G04C 21/00

[52] U.S. Cl. ..... 381/124; 364/400.01; 704/272; 215/291; 215/273; 215/336

[58] Field of Search ..... 381/124, 61, 118; 251/291, 273, 336; 704/272; 364/400.01

[56] References Cited

U.S. PATENT DOCUMENTS

| | | | |
|---|---|---|---|
| 3,904,062 | 9/1975 | Grussen . | |
| 4,361,408 | 11/1982 | Wirtschafter . | |
| 4,367,955 | 1/1983 | Ballew . | |
| 4,611,924 | 9/1986 | Stasin . | |
| 4,768,176 | 8/1988 | Kehr et al. . | |
| 4,791,741 | 12/1988 | Kondo | 40/124.1 |
| 4,801,929 | 1/1989 | Instance | 340/692 |
| 4,895,257 | 1/1990 | Winslow . | |
| 4,926,572 | 5/1990 | Holmes . | |
| 5,004,111 | 4/1991 | McCarthy | 215/232 |
| 5,011,032 | 4/1991 | Rollman . | |
| 5,014,798 | 5/1991 | Glynn | 177/25.19 |
| 5,020,037 | 5/1991 | Raven . | |
| 5,088,056 | 2/1992 | McIntosh et al. | 364/569 |
| 5,181,189 | 1/1993 | Hafner . | |
| 5,233,571 | 8/1993 | Wirtschafter . | |
| 5,313,439 | 5/1994 | Albeck . | |
| 5,412,372 | 5/1995 | Parkhurst et al. . | |
| 5,495,961 | 3/1996 | Maestre . | |
| 5,577,918 | 11/1996 | Crowell | 434/319 |

*Primary Examiner*—Forester W. Isen
*Attorney, Agent, or Firm*—McCormick, Paulding & Huber

[57] ABSTRACT

A closure for a medication container includes a recorder supported by the closure for recording and playing back a patient's instructions for taking the medication. The recorder includes a microphone, a speaker, a storage means, a play button, and a recessed record button. A liner is also provided and is releasably engaged with the closure such that a barrier is formed between the closure and the medication container. The closure also has a tab extending from its periphery. The tab has an aperture extending through it. A strap dimensioned to pass through the aperture is provided and has a tang with one end engageable with the tab to retain the strap in the aperture. The strap extends generally adjacent to the container when retained in the aperture and can be attached to the medication container by an adhesive strip thereby preventing complete separation of the closure from the container.

20 Claims, 1 Drawing Sheet

CLOSURE FOR SEALING A MEDICATION CONTAINER

FIELD OF THE INVENTION

The present invention relates generally to medication containers, and deals more particularly with closures for these containers capable of transmitting patient instructions.

BACKGROUND OF THE INVENTION

The present invention has particular utility with respect to closures for medication containers which audibly transmit instructions to the patient and is described herein as directed to such use.

Many people experience difficulty remembering the proper instructions for taking their medication. This is especially prevalent among the elderly and mentally impaired. Other patients have difficulty in comprehending the instructions printed on their medication containers due to poor vision, illiteracy or perhaps even a language barrier.

Typically, persons experiencing the problems described herein have had to rely on others for help, or they simply take their medication haphazardly hoping that they recall the proper dosage and time at which to take their medication. In many instances, the improper use of medication causes deterioration of the patient's condition and in some situations hospitalization. In the extreme, medication non-compliance can cause death.

The health problems associated with the improper usage of medication could be significantly reduced if a readily accessible, easily understood device for instructing patients as to the proper procedure for taking their medication were available.

It is important that such a device be in close proximity to the medication itself, and leave no margin of error as to which medication the particular instructions apply. Moreover, it would be highly beneficial if the instructions were auditory and in the language the person taking the medication understands.

Based on the foregoing, it is the general object of the present invention to provide a closure or cap for sealing medication containers which can record and playback the instructions for taking or using the medication stored in the container.

SUMMARY OF THE INVENTION

The present invention meets this and other objects by providing, in one aspect, a closure for sealing a medication container comprising a means for recording patient instructions regarding the proper use of the medication and a means for generating audio signals corresponding to the recorded instructions. The closure further includes a means for actuating the recording and audio signal generation functions.

In the preferred embodiment of the present invention, the means for recording the audio signals comprises a microphone which is supported by the closure and a storage means for retaining the recorded instructions for later retrieval. The microphone and storage means are connected to each other via recording circuitry. In addition, the means for generating audio signals includes a speaker supported by the closure as well as audio signal generation circuitry. The circuitry connects the storage means to the speaker and converts the recorded patient instructions encoded onto the storage means back to audio signals capable of output by the speaker. A record button is also attached to the closure and is connected to the recording means for movement between an "off" and a "record" position. In the "record" position, the patient's instructions can be encoded onto the storage means by speaking into the microphone. Similarly, a play button is attached to the closure and connected to the means for generating audio signals. The play button can be moved between an "off" position and a "play" position. When in the "play" position, the recorded patient instructions are converted back to audio signals for output by the speaker.

In still a further embodiment of the present invention, the aforementioned record button is recessed within the closure such that an implement is required to move the button to the record position thereby preventing improper or inadvertent recordings.

In yet another embodiment of the present invention, the closure includes an alarm feature in addition to the record and play features. When a preset time is reached, an alarm will sound alerting the patient that the time has come to take his or her medication.

In still an additional embodiment of the present invention, the closure incorporates a pressure sensitive play back switch interposed between the closure and the medication container such that when the closure is removed from the container, the switch is actuated allowing the instructions to be heard.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENTS

Figure 1:
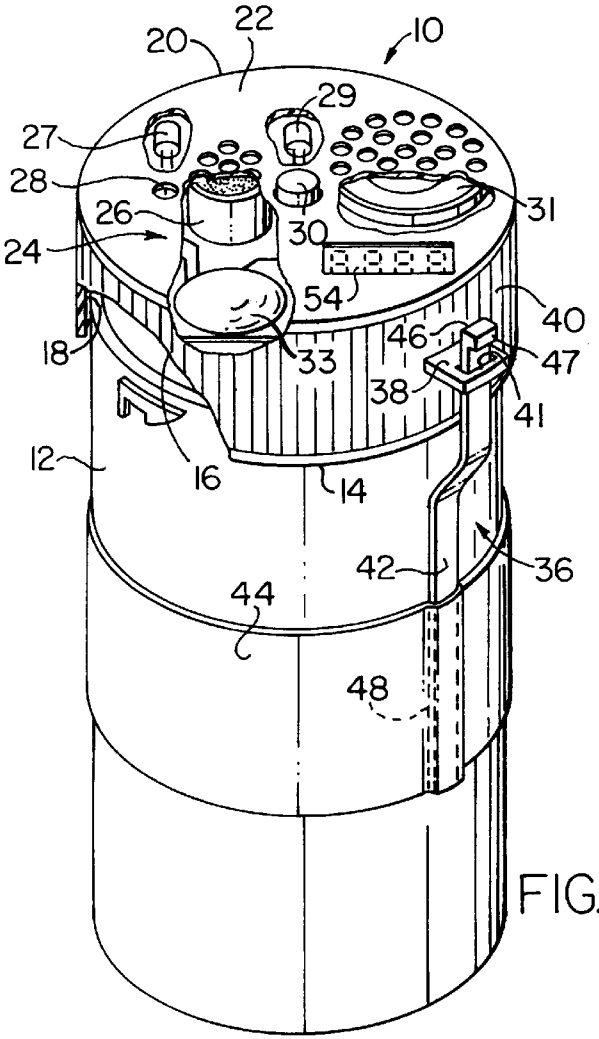
FIG. 1 is a partially sectioned perspective view of the closure of the present invention.

Referring now to the drawings in greater detail, FIG. 1 shows the closure 10 of the present invention. The closure is shown in sealing engagement with a medication container 12 and has an open lower end 14 as well as a cavity 16 defining an interior surface 18 which extends upwardly from the open lower end 14. The closure 10 further includes a closed upper end 20 having an upper surface 22.

Still referring to FIG. 1, a recorder 24 for recording patient instructions is supported by the upper surface 22 of the closure 10. The recorder includes a microphone 26, a record button 28, a play button 30 and a speaker 31. Additionally, the recorder includes a storage means 33 for retaining the recorded patient instructions. The record button 28 can be selectively moved between an "off" position and a "record" position. Furthermore, the record button 28 is recessed into the closure's upper surface such that an implement such as, for example, a ball point pen is needed to actuate the record button 28 thereby preventing any inadvertent recording of instructions. During operation, when the patient's instructions are to be recorded, the operator depresses the record button thereby activating the recorder, and speaks into the microphone 26.

Recording circuitry 27 is operably connected to the microphone 26 and the storage means 33 and provides for the encoding of the audio signals received by the microphone 26 onto the storage means.

In order to play back the recorded instructions, the play button 30 which can be selectively moved between an "off" position and a "play" position is pressed. Audio signal generation circuitry 29 is operably connected to the storage means 33 and the speaker 31 such that when the play button is moved to the "play" position, the recorded patient instructions are converted back to audio signals and output via the speaker 31 in a manner which can be readily heard by the person taking the medication.

Figure 2:
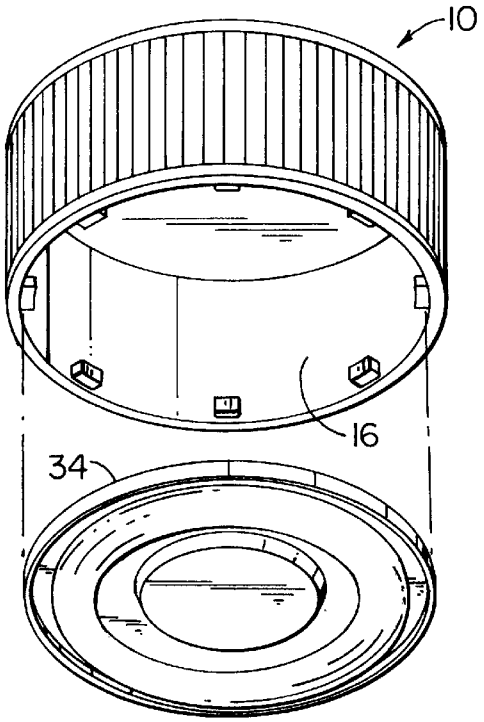
FIG. 2 is an exploded view of the closure of FIG. 1.

Turning now to FIG. 2, in many instances prescriptions are refilled one or more times, with the same instructions for taking the medication. However, in some locales, due to local regulations, the medication container and closure cannot be reused. In order to avoid having to provide a new closure, containing the same instructions, each time a prescription is refilled, a removable liner 34 is provided between the closure 10 and the medication container 12. The liner 34 is releasably engaged with the interior surface and supported within the cavity 16, and when so engaged, the liner 34 forms a barrier between the interior closure surface 18 and the medication container 12.

Therefore, when a prescription is refilled, the pharmacist replaces the medication container 12 and the liner 34 and reuses the closure 10.

Still referring to FIG. 1 a retaining means 36 is provided to ensure that the closure remains with the medication container 12 for which the recorded instructions apply.

The retaining means 36 consists of a tab portion 38 integral with and extending from an outer periphery 40 of the closure 10, and having an aperture 41 extending therethrough. A flexible retaining member 42 is slidably engaged at one end 46 with the aperture 41, and attached at an opposite end 48 to the medication container 12 by the label tape 44 which is placed over the prescription label. While label tape is shown and described, the invention should not be limited in this regard as any type of adhesive strip known to those skilled in the art may be substituted without departing from the broader aspects of the invention. Therefore, when, as described above, the prescription is refilled, the pharmacist simply cuts the flexible member 42 and discards it. When the closure 10 is placed on the new medication container, the flexible member 42 is replaced by sliding it through the aperture 41 and attaching it to the container with a new piece of label tape 44 thereby preventing complete separation of the closure 10 and the medication container 12. Various versions of the flexible member 42 may be used with the retaining means 36. One such version is a strap 42 dimensioned to pass through the aperture 41 (shown in FIG. 1). The strap 42 has a tang 47 at one end which is larger than the aperture 41, and another end 48 dimensioned to pass through the aperture. The strap 42 extends generally adjacent to the container when retained in the aperture and is attachable to the medication container 12 by an adhesive strip 44 thereby preventing complete separation of the closure 10 from the container.

Figure 3:
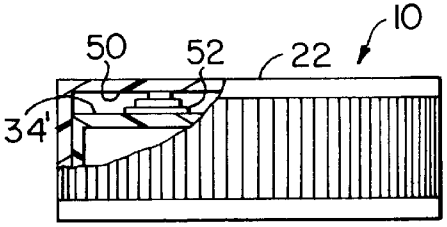
FIG. 3 is a partially sectioned front view of an alternate embodiment of the closure of the present invention.

In an alternate embodiment of the present invention, shown in FIG. 3, the closed upper end 20 of the closure 10 has a lower surface 50. In this embodiment the previously described play button is replaced by a pressure sensitive play back switch 52 operably connected to the audio signal generation circuitry (not shown). The pressure sensitive play back switch 52 extends from the lower surface 50 and is positioned between it and a liner 34'. When the closure 10 is sealably engaged with the medication container 12, the pressure sensitive play back switch 52 is in the "off" position. When the closure 10 is disengaged from the medication container 12, the pressure sensitive play back switch 52 automatically moves to the "play" position thereby causing the recorded instructions to be heard through the speaker 31.

Referring back to FIG. 1 in still another embodiment of the present invention, the closure further includes a digital display 54 supported by with the upper surface 22.

In still a further embodiment of the present invention, the closure 10 includes an alarm function such that an audible alarm sounds at preset times corresponding to the intervals at which the medication should be taken.

In addition to the foregoing, the dimensions of the liner 34 used with the closure 10 of the present invention can be adjusted such that one size closure can be used to accommodate several different sizes of medication containers.

While preferred embodiments have been shown and described, various modifications and substitutions may be made without departing from the spirit and scope of the invention. Accordingly, it is to be understood that the present invention has been described by way of example and not by limitation.

I claim:

1. A reusable closure for sealing the top of a medication container comprising:

a recorder positioned within the reusable closure for recording verbal patient instructions for the proper use of the medication;

means for generating audio signals corresponding to the recorded instructions;

means for actuating the recorder and the audio signal generation means; and retaining means slidably and releasably received by the closure at one end and coupled to the medication container at an opposite end for preventing the closure from being completely separated from the medication container.

2. The reusable closure of claim 1 further comprising a disposable liner releasably engaged with the closure and interposed between the closure and the medication container, such that upon reuse of the closure, the disposable liner can be discarded and a new disposable liner substituted.

3. The reusable closure of claim 1 wherein the recorder comprises:

a microphone supported by the closure;

storage means supported by the closure for retaining the recorded instructions for later retrieval; and recording circuitry operably connected to the microphone and the storage means for encoding the verbal audio signals received by the microphone onto the storage means.

4. The reusable closure of claim 3 wherein the means for generating audio signals comprises:

a speaker supported by the closure; and audio signal generation circuitry operably connected to the storage means and the speaker for converting the patient instructions encoded onto the storage means to verbal audio signals capable of output by the speaker.

5. The reusable closure of claim 4 wherein the means for actuating the recording means and the audio signal generation means comprises:

a record button attached to the closure and operably connected to the recorder for selective movement between an "off" position and a "record" position, such that when in the "record" position, the recording means is activated allowing verbal patient instructions to be recorded; and a play button attached to the closure and operably connected to the means for generating audio signals for selective movement between an "off" position and a "play" position, such that when in the "play" position patient instructions are converted to verbal audio signals for output by the speaker.

6. The reusable closure of claim 5 wherein the record button is recessed within the closure such that an implement is required to move the button to the record position.

7. The reusable closure of claim 1 having an open lower end, and a closed upper end.

8. The reusable closure of claim 7 further having an interior surface defining an interior cavity, and a disposable liner releasably engaged with the interior surface and supported within the cavity.

9. The reusable closure of claim 7 wherein the closed upper end has an upper surface; and the recorder, the means for generating verbal audio signals, and the means for actuating are all operably attached to the closure upper surface.

10. The reusable closure of claim 9 wherein:

the closed upper end defines a lower surface, and the closure further comprising:

a pressure sensitive play back switch supported on the lower surface and operably connected to the means for generating audio signals such that when the closure is sealably engaged with the medication container, the pressure sensitive play back switch is in the "off" position, and when the closure is disengaged from the medication container, the pressure sensitive play back switch automatically moves to the play position thereby activating the means for generating audio signals.

11. The reusable closure of claim 9 further comprising a recessed record button supported by the closure such that an implement is required to move the button between an "off" and a record position.

12. The reusable closure of claim 1 having an outer periphery and the retaining means including an integral tab portion extending from the outer periphery and having an aperture extending therethrough; and a flexible retaining member slidably engaged at one end with the aperture, and attached at an opposite end to the medication container.

13. The reusable closure of claim 12 wherein the flexible retaining member comprises a strap dimensioned to pass through the aperture, the strap having a tang with one end engageable with the tab to retain the strap in the aperture, the strap extending generally adjacent to the container when retained in the aperture and being attachable to the medication container by an adhesive strip thereby preventing complete separation of the closure from the container.

14. The reusable closure of claim 1 wherein, a single reusable closure is dimensioned such that it can be received by a plurality of medication containers of different size.

15. The reusable closure of claim 1 further comprising a digital display supported by the reusable closure.

16. The reusable closure of claim 1 further including a timer and alarm for generating audible signals at specified intervals.

17. A closure for sealing the top of a medication container comprising:

means for recording patient instructions for the proper use of the medication;

means for generating audio signals corresponding to the recorded instructions;

means for actuating the recording means and the audio signal generation means; and wherein the closure includes an outer periphery and, an integral tab portion extending from the outer periphery defining an aperture extending therethrough; and a flexible retaining member slidably engaged at one end with the aperture, and attached at an opposite end to the medication container.

18. A closure for sealing a medication container having an open lower end, and a closed upper end and further comprising:

a microphone supported by the upper end;

storage means supported by the closure for retaining patient instructions for later retrieval;

recording circuitry operably connected to the microphone and the storage means for encoding the audio signals received by the microphone onto the storage means;

a speaker supported by the closure;

audio signal generation circuitry operably connected to the storage means and the speaker for converting the patient instructions encoded onto the storage means to audio signals capable of output by the speaker;

a record button attached to the closure and operably connected to the recording means for selective movement between an "off" position and a "record" position, such that when in the "record" position, the recording means is activated allowing the patient instructions to be recorded;

a play button attached to the closure and operably connected to the means for generating audio signals for selective movement between an "off" position and a "play" position, such that when in the "play" position, the recorded patient instructions are converted to audio signals for output by the speaker; and the record button being recessed within the closure such that an implement is required to move the button to the record position;

a tab portion integral with and extending from a periphery of the closure and having an aperture extending therethrough; and strap dimensioned to pass through the aperture, the strap having a tang with one end engageable with the tab to retain the strap in the aperture, the strap extending generally adjacent to the container when retained in the aperture and being attachable to the medication container by an adhesive strip thereby preventing complete separation of the closure from the container.

19. The closure of claim 18 further having an interior surface defining an interior cavity, and a liner releasably engaged with the interior surface and supported within the cavity.

20. A closure for sealing the top of a medication container comprising:

the closure including an open lower end, and a closed upper end having an upper and a lower surface;

a recorder operably attached to the closure upper surface for recording verbal patient instructions for the proper use of the medication;

means for generating audio signals corresponding to the recorded instructions operably attached to the closure upper surface;

means for actuating the recorder, operably attached to the closure upper surface;

a pressure sensitive play back switch supported on the lower surface and operably connected to the means for generating audio signals such that when the closure is sealably engaged with the medication container, the pressure sensitive play back switch is in the "off" position, and when the closure is disengaged from the medication container, the pressure sensitive play back switch automatically moves to the play position thereby activating the means for generating audio signals; and retaining means slidably and releasably received by the closure at one end and coupled to the medication container at an opposite end for preventing the closure from being completely separated from the medication container.

* * * * *